US008042928B2

(12) United States Patent
Hongo et al.

(10) Patent No.: US 8,042,928 B2
(45) Date of Patent: Oct. 25, 2011

(54) LIQUID CONTAINER, FUEL CELL SYSTEM AND METHOD FOR CONTROLLING FUEL CELL SYSTEM

(75) Inventors: Takuya Hongo, Kawasaki (JP); Norihiro Tomimatsu, Mitaka (JP); Takahiro Suzuki, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 943 days.

(21) Appl. No.: 12/018,415

(22) Filed: Jan. 23, 2008

(65) Prior Publication Data

US 2008/0174644 A1 Jul. 24, 2008

(30) Foreign Application Priority Data

Jan. 23, 2007 (JP) ..... 2007-012777

(51) Int. Cl.
*B41J 2/19* (2006.01)
*F04B 37/02* (2006.01)

(52) U.S. Cl. ..... 347/92; 347/84; 347/85; 347/86; 417/48; 417/379

(58) Field of Classification Search ..... None
See application file for complete search history.

(56) References Cited

U.S. PATENT DOCUMENTS

| | | | | |
|---|---|---|---|---|
| 6,431,672 | B1 | 8/2002 | Ardito et al. | |
| 6,994,932 | B2 * | 2/2006 | Kinkelaar et al. | 429/447 |
| 7,708,369 | B2 * | 5/2010 | Hanaoka et al. | 347/19 |
| 2009/0136362 | A1 * | 5/2009 | Yanagisawa et al. | 417/48 |

FOREIGN PATENT DOCUMENTS

| | | |
|---|---|---|
| JP | 5-42680 | 2/1993 |
| WO | WO 2006106884 A1 * | 10/2006 |

* cited by examiner

*Primary Examiner* — Matthew Luu
*Assistant Examiner* — Erica Lin
(74) *Attorney, Agent, or Firm* — Oblon, Spivak, McClelland, Maier & Neustadt, L.L.P.

(57) ABSTRACT

A liquid container includes a hollow body; a tubular suction port coupled to the hollow body; a first porous member disposed in the hollow body; a second porous member disposed in the suction port and being in contact with the first porous member, the second porous member having a liquid suction capability higher than that of the first porous member, wherein at least one of the first and second porous members has a recess so as to establish an air bubble collector.

13 Claims, 6 Drawing Sheets

LIQUID CONTAINER, FUEL CELL SYSTEM AND METHOD FOR CONTROLLING FUEL CELL SYSTEM

CROSS REFERENCE TO RELATED APPLICATIONS AND INCORPORATION BY REFERENCE

This application is based upon and claims the benefit of priority from the prior Japanese Patent Application No. P2007-12777, filed on Jan. 23, 2007; the entire contents of which are incorporated herein by reference.

BACKGROUND OF THE INVENTION

1. Field of the Invention

The present invention relates to a liquid container in which a porous member is installed, a fuel cell system using the liquid container, and a method for controlling the fuel cell system.

2. Description of the Related Art

Various effects can be obtained by installing a hydrophilic porous member within a fuel container or a liquid container, such as an ink container for an ink-jet printer, having a form similar to that of a fuel container. Specifically, by installing a hydrophilic porous member, the liquid can be sucked out from the container no matter which direction the container faces with respect to the direction of the gravity.

However, the installation of the hydrophilic porous member reduces, by the amount of its own volume, the volume of the liquid accommodated in the container. Accordingly, it is necessary to suck out as much fuel as possible from the hydrophilic porous member. However, suppose the case where the liquid is sucked from a container through a hydrophilic porous member with a pump. In this case, when the residual amount of the liquid contained in the hydrophilic porous member becomes not more than a specific amount, air bubbles will enter the sucked liquid, and consequently the liquid with air bubbles will directly flow into a liquid pump to adversely affect the pump performance.

Accordingly, it is required to detect the residual amount of the liquid contained in the hydrophilic porous member at the moment when air bubbles start to enter the liquid which is being sucked with a pump (hereinafter, such a residual amount referred to as "near end"). In addition, it is required to prevent air bubbles from entering the fuel that is sucked from the fuel container upon detection of the near end.

There is, for example, the following method for preventing the entry of air bubbles. In this method, a cavity part is provided between a hydrophilic porous member A and a hydrophilic porous member B that is disposed at a position closer to a suction port than the hydrophilic porous member A. Then, the near end is detected by visually checking whether or not an air bubble enters this cavity part. As can be seen in the configuration of a water-based-ink pen or the like, the liquid suction capability of the hydrophilic porous member B is, in many cases, set higher than that of the hydrophilic porous member A for the purpose of increasing the suction rate of the liquid.

However, with this near end detection, air bubbles will eventually start to enter the sucked liquid unless the container is promptly replaced before the liquid in the cavity part is depleted. A time sufficient for the replacement of a container can be obtained if the suction of liquid is stopped completely once. However, in a case where this method is applied to a fuel cell system or the like, it is not suitable to completely stop the suction of liquid in view of the operation performance. Moreover, although a time sufficient for the replacement of the container can be obtained by providing a cavity part with a sufficient size, the area of a window necessary for the visual check will increase. Even if the air bubble detection is performed by using an optical or electrical mechanism instead of the visual check, the detection area will increase as the window becomes large. Therefore, for miniaturizing the liquid container or the liquid consuming apparatus, it is disadvantageous to provide a cavity part with a sufficient size and is thus not suitable, either.

In an example shown in JP-A H5-42680 (KOKAI), a part of the wall of an ink tank, which is in contact with a porous member, is formed of an acrylic resin, and a plurality of groove parts different in capillary force are formed in the inner surface of the acrylic wall. Here, the residual amount of ink can be detected by utilizing the fact that the state of an ink entering the grooves formed as capillary tubes changes due to the magnitude relation between the capillary force of the porous member and that of the groove on the wall of the ink tank. Installing the above-described mechanism in the suction port of the liquid container makes it possible to detect the near end.

However, particularly in the case where the ink is sucked with a pump, at the time when air bubbles enter the groove part and the near end is detected, a lot of air bubbles have already entered the porous member around the groove part. Accordingly, air bubbles can enter the sucked ink as well.

An example shown in U.S. Pat. No. 6,431,672 includes ink reservoirs different in capillary forces. The ink reservoir having the higher capillary force is provided with an ink outlet and an ink level sensor. The ink level sensor is a C-shaped tube with both ends connected to the ink reservoir having the higher capillary force. Here, the capillary force is designed so that the ink in the tube is depleted when the amount of ink in the ink reservoir having the higher capillary force becomes low, thereby obtaining the function to detect the near end.

However, particularly in the case where the ink is sucked with a pump, a large number of air bubbles have already entered the ink reservoir having the higher capillary force when air bubbles enter the ink level sensor and the near end is detected. Accordingly, air bubbles can enter the sucked ink as well.

In addition, if the ink level sensor is connected not to the ink reservoir having the higher capillary force but to the ink reservoir having the smaller capillary force, the ink reservoir tank having the higher capillary force may achieve a state where there is almost no entry of air bubbles when the ink level sensor detects the near end of the ink reservoir.

However, this near end detection will detect a state where the residual amount of ink is more than that in the case where the ink level sensor is connected to the ink reservoir having the higher capillary force. Therefore, in order to detect a state where the residual amount of ink is as small as possible, a more creative study is required.

SUMMARY OF THE INVENTION

An aspect of the present invention inheres in a liquid container encompassing a hollow body; a tubular suction port coupled to the hollow body so as to form a closed receptacle; a first porous member disposed in the hollow body; a second porous member disposed in the suction port and being in contact with the first porous member, the second porous member having a liquid suction capability higher than that of the first porous member, wherein at least one of the first and second porous members has a recess so as to establish an air bubble collector, the recess is defined by the suction port, by the first porous member, and by the second porous member.

Another aspect of the present invention inheres in a fuel cell system encompassing a fuel cell unit; a liquid container configured to store fuel to be delivered to the fuel cell unit, the liquid container including: a hollow body; a tubular suction port coupled to the hollow body so as to form a closed receptacle; a first porous member disposed in the hollow body; and a second porous member disposed in the suction port and being in contact with the first porous member, the second porous member having a liquid suction capability higher than that of the first porous member, at least one of the first and second porous members has a recess so as to establish an air bubble collector, the recess is defined by the suction port, by the first porous member, and by the second porous member; a detector configured to detect an air bubble within the air bubble collector; and a controller configured to control a delivery flow rate of fuel from the liquid container based on a detection result of the air bubble.

Still another aspect of the present invention inheres in a method of controlling a fuel cell system encompassing operating the fuel cell system, the fuel cell system including a liquid container including a hollow body, a tubular suction port coupled to the hollow body so as to form a closed receptacle, a first porous member disposed in the hollow body, and a second porous member disposed in the suction port and being in contact with the first porous member, the second porous member having a liquid suction capability higher than that of the first porous member, at least one of the first and second porous members has a recess so as to establish an air bubble collector, the recess is defined by the suction port, by the first porous member, and by the second porous member; detecting an air bubble within the air bubble collector; and controlling a delivery flow rate of fuel from the liquid container on a basis of a detection result of the air bubble.

DETAILED DESCRIPTION OF THE INVENTION

Figure 1:
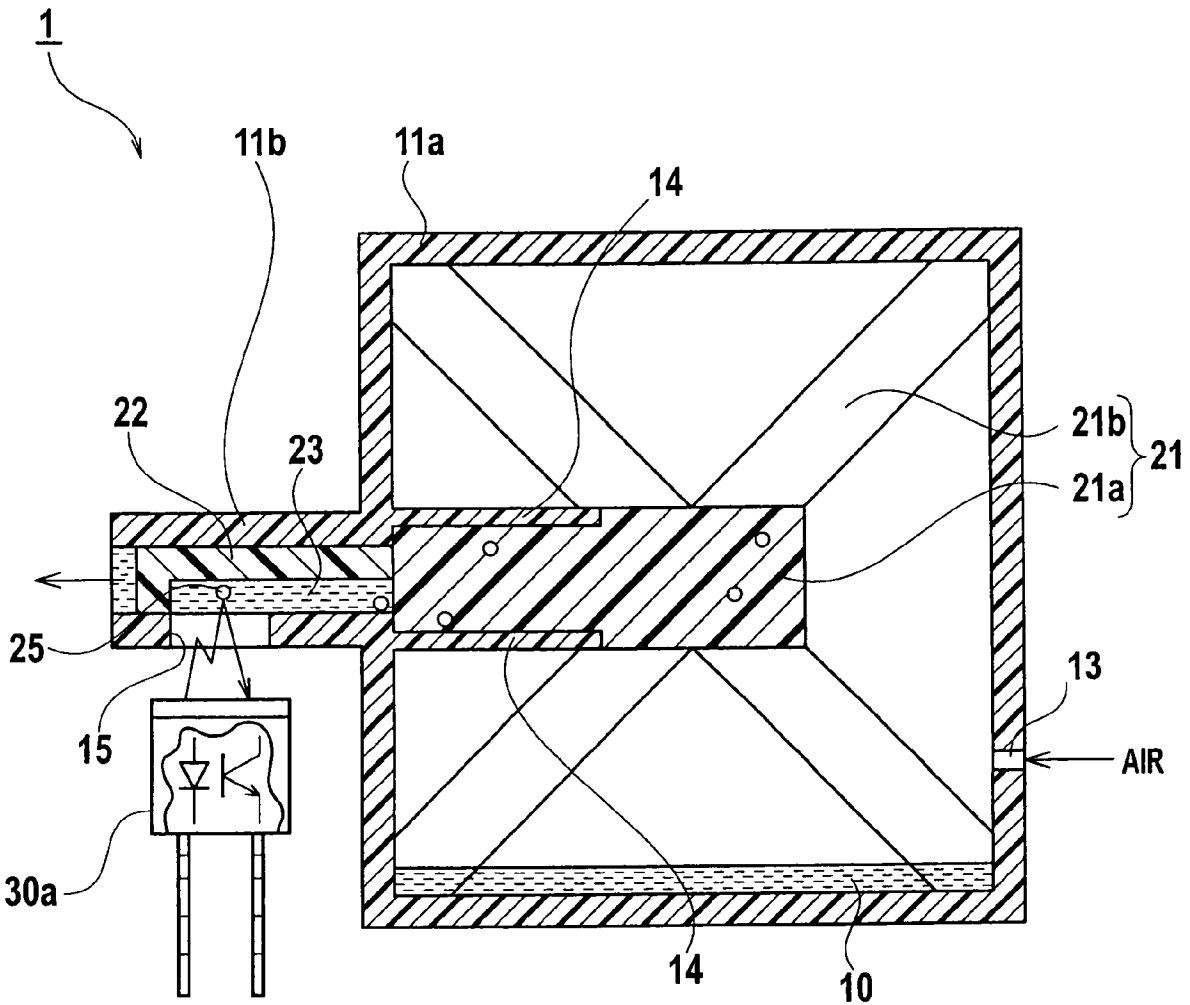
FIG. 1 is a cross-section view illustrating an example of a liquid container according to an embodiment.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified. In the following descriptions, numerous details are set forth such as specific signal values, etc. to provide a thorough understanding of the present invention. However, it will be obvious to those skilled in the art that the present invention may be practiced without such specific details.

(Liquid Container)

As shown in FIG. 1, a liquid container 1 according to the present invention includes a hollow body 11*a*, a tubular suction port 11*b*, a first porous member 21, a second porous member 22, and an air bubble collector 23. The hollow body 11*a* is implemented by a hollow shape configured to accommodate liquid 10. The tubular suction port 11*b* is disposed outside of the hollow body 11*a* and coupled to the hollow body 11*a* so as to form a closed receptacle, which can accommodate the liquid 10.

The first porous member 21 is disposed in the hollow body 11*a*. The second porous member 22 is disposed in the suction port 11*b* and is in contact with the first porous member 21. The second porous member 22 has a liquid suction capability higher than that of the first porous member 21, and has a recess 22*c* (see FIG. 2). The air bubble collector 23 is established in the recess 22*c* so as to be in contact with a part of the boundary face between the second porous member 22 and the first porous member 21.

Various modifications can be made on the liquid container 1, in accordance with how or for what purpose the liquid container 1 is to be used. In FIG. 1, the liquid container 1 includes the rectangular parallelepiped hollow body 11*a* with a width of 20 mm, a height of 25 mm, and a length of 80 mm, and the tubular suction port 11*b* with an outer diameter of 4 mm, an inner diameter of 2 mm, and a length of 6 mm.

The liquid container 1 is made of a material resistant to liquid 10 that is contained therein, such as polyetherimide or the like. In addition, in order to easily accommodate the first porous member 21 and the second porous member 22 in the liquid container 1, it is suitable that the liquid container 1 should have a structure in which the hollow body 11*a* and the suction port 11*b* can be separated and assembled.

At the wall of the hollow body 11*a*, a hole with a diameter of 1 mm is provided as an air intake 13 for the hollow body 11*a*. Inside the hollow body 11*a*, a porous member fixing pipe 14 of cylindrical (tubular) shape with an outer diameter of 10 mm, an inner diameter of 8 mm, and a length of 5 mm is disposed in order to fix the first porous member 21 and prevent air bubbles from entering the liquid 10 from the first porous member 21.

Although not illustrated here, each of the air intake 13 and the suction port 11*b* has a valve, and the valve is closed when the liquid container 1 is not coupled to a fuel cell system described later.

A window 15 made of an optically transparent material is formed at the wall (cylindrical (tubular) surface) of the suction port 11*b*. The air bubble collector 23 is positioned in a region that is in contact with the window 15 in the suction port 11*b*, so that air bubbles 25 collected in the air bubble collector 23 can be optically detected from the outside of the suction port 11*b*.

As the first porous member 21, a hydrophilic porous member using a cellulose sponge and the like is suitable. The first porous member 21 includes a first absorber 21*a* and a second absorber 21*b*. In a free state before being inserted into the porous member fixing pipe 14, the first absorber 21*a* has a cylindrical (tubular) shape with a diameter of 10 mm and a length of 10 mm. The first absorber 21*a* with the diameter of 10 mm and the length of 1 mm is compressed and embedded in the porous member fixing pipe 14.

As described above, since the first absorber 21*a* whose diameter is larger than the inner diameter of the porous member fixing pipe 14 is compressed and embedded in the porous member fixing pipe 14, the side wall (cylindrical (tubular) surface) of the first absorber 21*a* is urged to be close in contact with the inner wall of the porous member fixing pipe 14. Accordingly, the first absorber 21*a* can be prevented from falling off the porous member fixing pipe 14, and at the same time an air (air bubbles 25) can be prevented from entering the liquid 10 through a gap between the first absorber 21*a* and the wall of the porous member fixing pipe 14.

The second absorber 21*b* is, for example, formed by cutting out some portions from a cellulose sponge with the same shape as the hollow body 11*a*. Here, the cellulose sponge is cut out without impairing the function of the second absorber 21*b* to suck the liquid 10 even when the liquid container 1 is inclined within its specifications. In addition, it is preferable that the volume of the second absorber 21*b* occupied in the hollow body 11*a* should be reduced as much as possible.

For example, as shown in FIG. 1, the hollow body 11*a* may accommodate the second absorber 21*b* with a shape radially extending from a center portion of the hollow body 11*a* where the first absorber 21*a* is disposed, to the corners of the hollow body 11*a*.

Figure 2:
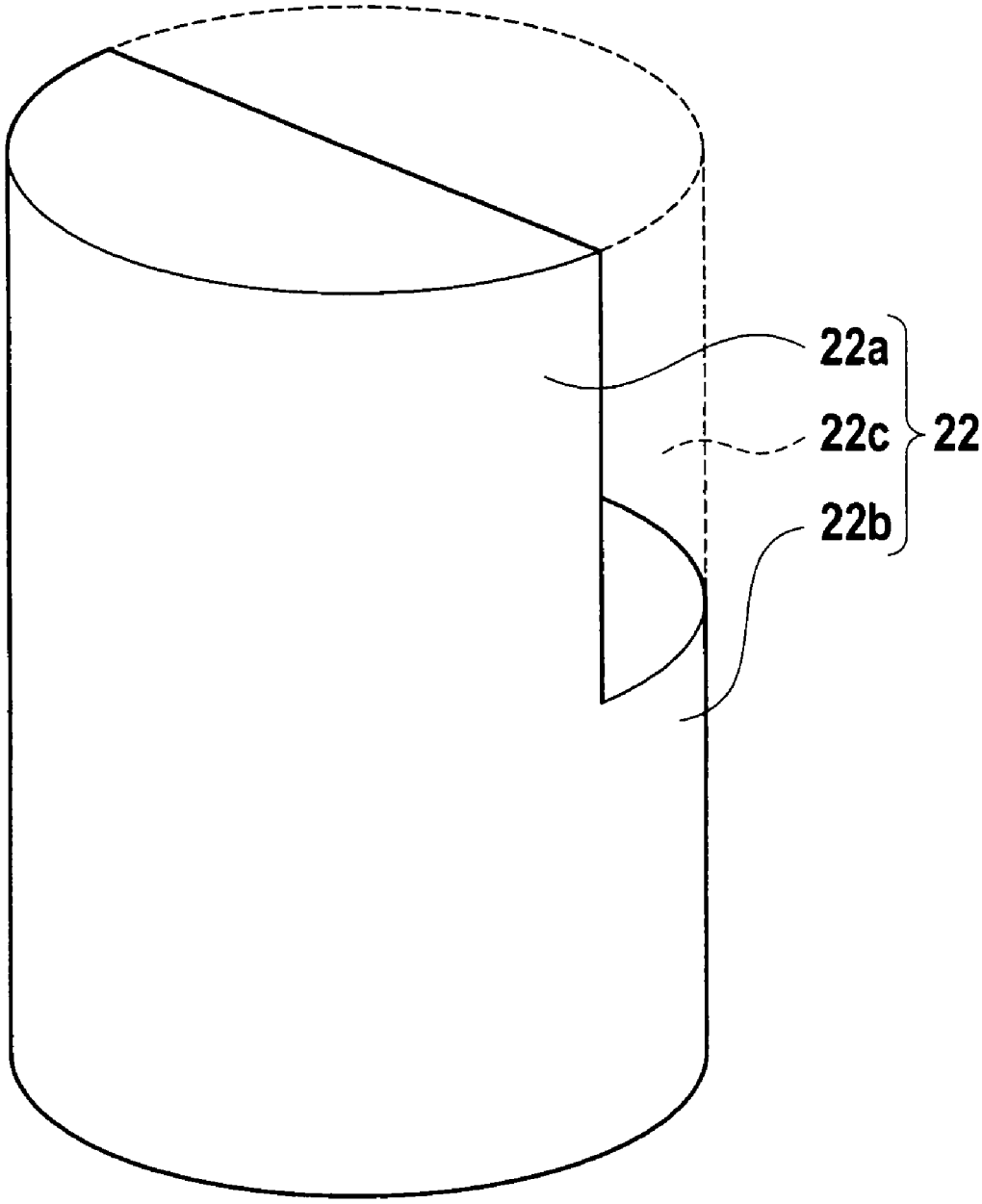
FIG. 2 is a perspective view illustrating an example of a second porous member according to the embodiment.

As the second porous member 22, a hydrophilic porous member made of a fiber bundle that is held together by a binder is suitable. As shown in FIG. 2, the second porous member 22 forms a shape obtained by chipping off, from a cylindrical (tubular) porous member with a diameter of 2 mm and a height of 5.5 mm, an upper right half (semi-cylindrical portion) shown in FIG. 2 with a radius of 1 mm and a height of 3.5 mm. That is, the second porous member 22 is composed of a first longitudinally cut cylinder part (semi-cylindrical part) 22*a* with a diameter of 2 mm and a height of 5.5 mm, and a second longitudinally cut cylinder part (semi-cylindrical part) 22*b* with a diameter of 2 mm and a height of 2.0 mm. In other words, the second porous member 22 is a porous member having the recess 22*c*.

As shown in FIG. 1, the top part, of the first longitudinally cut cylinder part 22*a*, which is adjacent to the recess 22*c* is in contact with the first porous member 21. By disposing the recess 22*c* of the second porous member 22 as shown in FIG. 1, a part of the boundary face between the second porous member 22 and the first porous member 21 is exposed to the recess 22*c* (not illustrated in FIG. 1). The recess 22*c*, which is a space defined by the first porous member 21, the second porous member 22, and the suction port 11*b* including the window 15, serves as the air bubble collector 23 for collecting the air bubbles 25 delivered from the first porous member 21 side.

The air bubble collector 23 is filled with the liquid 10 that is sucked from the hollow body 11*a*. The air bubbles 25 pass through the air bubble collector 23 before passing through the interior of the second porous member 22, since it is easier for the air bubbles 25 delivered from the first porous member 21 to pass through the air bubble collector 23 filled with the liquid 10 than to pass through the interior of the second porous member 22.

As a result, the generated air bubbles 25 can be selectively trapped within the air bubble collector 23. Accordingly, upon detection of the trapped air bubbles 25 with a detector 30*a* or the like, the delivery of the liquid 10 can be stopped or the delivery flow rate of the liquid 10 can be decreased. Therefore, the air bubbles 25 can be prevented from being generated in large quantities and thus from entering the liquid 10 that is sucked from the liquid container 1.

Here, for the second porous member 22, it is preferable to select a material having the liquid suction capability higher than that of the first porous member 21. Hereinafter, a method for evaluating the "liquid suction capability" in the present invention is described. The liquid suction capability Pc [Pa] of a porous member for sucking a certain liquid is evaluated with Equation (1) below.

$$Pc=(\sigma \cos \theta)/r_{eff} \quad (1)$$

Here, σ is the surface tension [Pa·s] of the certain liquid, θ is the contact angle [°] between the porous member and the certain liquid, and $r_{eff}$ [N/m] is the effective radius of holes of the porous member and is evaluated by Equation (2) below.

$$r_{eff}=C[[K(1-\epsilon)^2]/\epsilon^3]^{1/2} \quad (2)$$

ϵ: porosity [–]

K: permeability [$m^2$]

C: a constant in the range from the proportionality constant of Carman-Kozeny to the proportionality constant of Blake-Kozeny (including the proportionality constant of Carman-Kozeny and the proportionality constant of Blake-Kozeny)

According to the liquid container 1 shown in FIG. 1, since the liquid suction capability of the second porous member 22 is higher than the liquid suction capability of the first porous member 21, the near-end detection using a difference between the capillary forces is possible. In contrast, if the liquid suction capability of the first porous member 21 is higher, the liquid within the second porous member 22 may be selectively sucked to the outside of the liquid container 1. Accordingly, the near-end detection will be difficult.

Furthermore, since the first porous member 21 in contact with the second porous member 22 is accommodated in the hollow body 11*a* shown in FIG. 1, the liquid 10 can be sucked out from the container 1, in whichever direction the liquid container 1 is oriented with respect to the direction of gravity.

Furthermore, since the window 15 made of an optically transparent material is allocated in a region of the suction port 11*b* in which the air bubble collector 23 is disposed, the state of the trapped air bubbles 25 can be optically auto-detected with the detector 30*a* disposed so as to face the window 15. Moreover, the state of the air bubble collector 23 may be visually checked via the window 15.

Note that although described in detail in a method for operating a fuel cell system described later, by detecting the entry of the air bubbles 25 into the air bubble collector 23 with the detector 30*a*, and by decreasing, on the basis of the detection result, the flow rate of the liquid 10 sucked from the suction port 11*b*, the entry of the air bubbles 25 into the air bubble collector 23 can be prevented while the suction of the liquid 10 is being continued. Accordingly, the time required for a user to replace the liquid container 1 can be secured while preventing that the air bubbles 25 from entering the apparatus to which the liquid container 1 is coupled.

FIGS. 3A to 3D show the examples of arrangement of the first porous member 21, the second porous member 22, and the air bubble collector 23. In FIGS. 3A to 3D, an arrow indicates the direction in which the liquid and air bubbles 25 are sucked out.

Figure 3A:
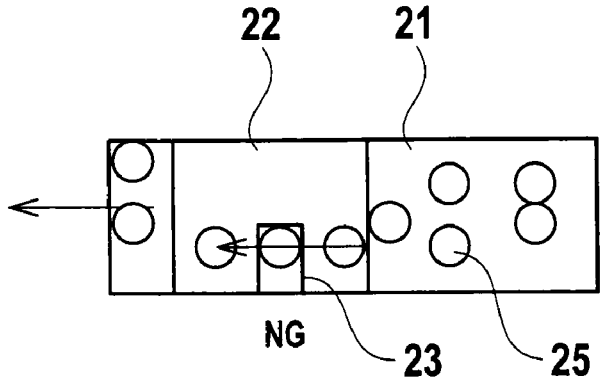
FIGS. 3A thorough 3D are explanation diagrams illustrating arrangement examples of an air bubble collector according to the embodiment.

As shown in an example of FIG. 3A, in the case where the air bubble collector 23 not in direct contact with the first porous member 21 is provided in the interior of the second porous member 22, a large number of air bubbles 25 have already entered the second porous member 22 at the time when the air bubbles 25 are collected in the air bubble collector 23. Accordingly, the air bubbles 25 will enter the liquid to be sucked.

Figure 3B:
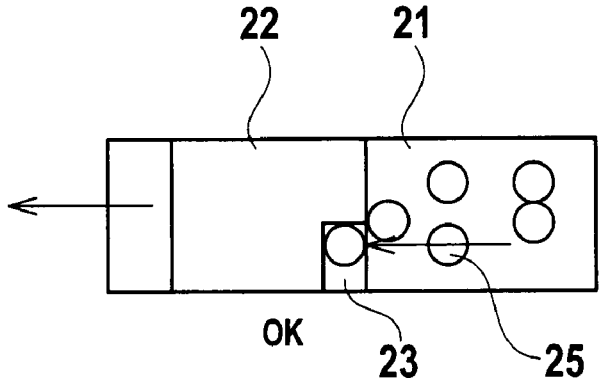

On the other hand, as shown in an example of FIG. 3B, in the case where the air bubble collector 23 is provided in a recess of the second porous member 22 so as to contact with a part of the boundary face between the second porous member 22 and the first porous member 21, the air bubbles 25 contained in the first porous member 21 will be collected in the air bubble collector 23 before entering the second porous member 22. Accordingly, at the time when the air bubbles 25 are collected, no air bubble exists in the second porous member 22, and thus it is possible to prevent the entry of air bubbles into the liquid at the outlet side of the container.

Figure 3C:
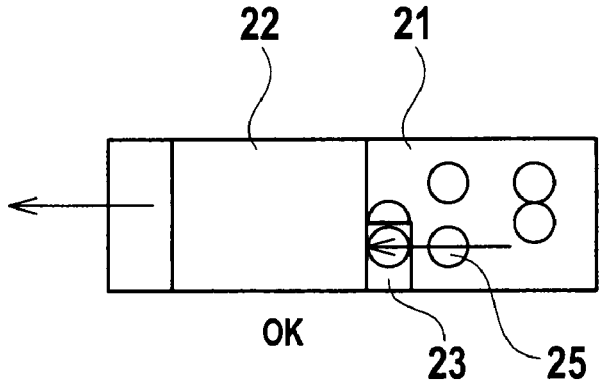

Moreover, as shown in an example of FIG. 3C, also in the case where the air bubble collector 23 is provided in a recess of the first porous member 21 so as to contact with a part of the boundary face between the first porous member 21 and the second porous member 22, the air bubbles 25 contained in the first porous member 21 will be collected in the air bubble collector 23 before entering in the second porous member 22. Accordingly, at the time when the air bubbles 25 are collected, no air bubble exists in the second porous member 22, and thus it is possible to prevent the entry of air bubbles into the liquid at the outlet side of the container.

Figure 3D:
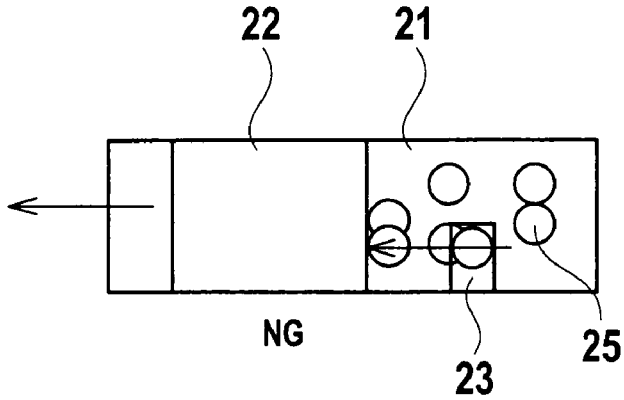

On the other hand, as shown in an example of FIG. 3D, in the case where the air bubble collector 23 not in direct contact with the second porous member 22 is provided in the interior of the first porous member 21, at the time when the air bubbles 25 are collected, no air bubble exists in the second porous member 22. However, here, the air bubbles 25 will be detected while a sufficient amount of liquid is left in the liquid container 1. Accordingly, the liquid cannot be sucked out as much as the examples shown in FIG. 3B and FIG. 3C.

(Fuel Cell System)

Figure 4:
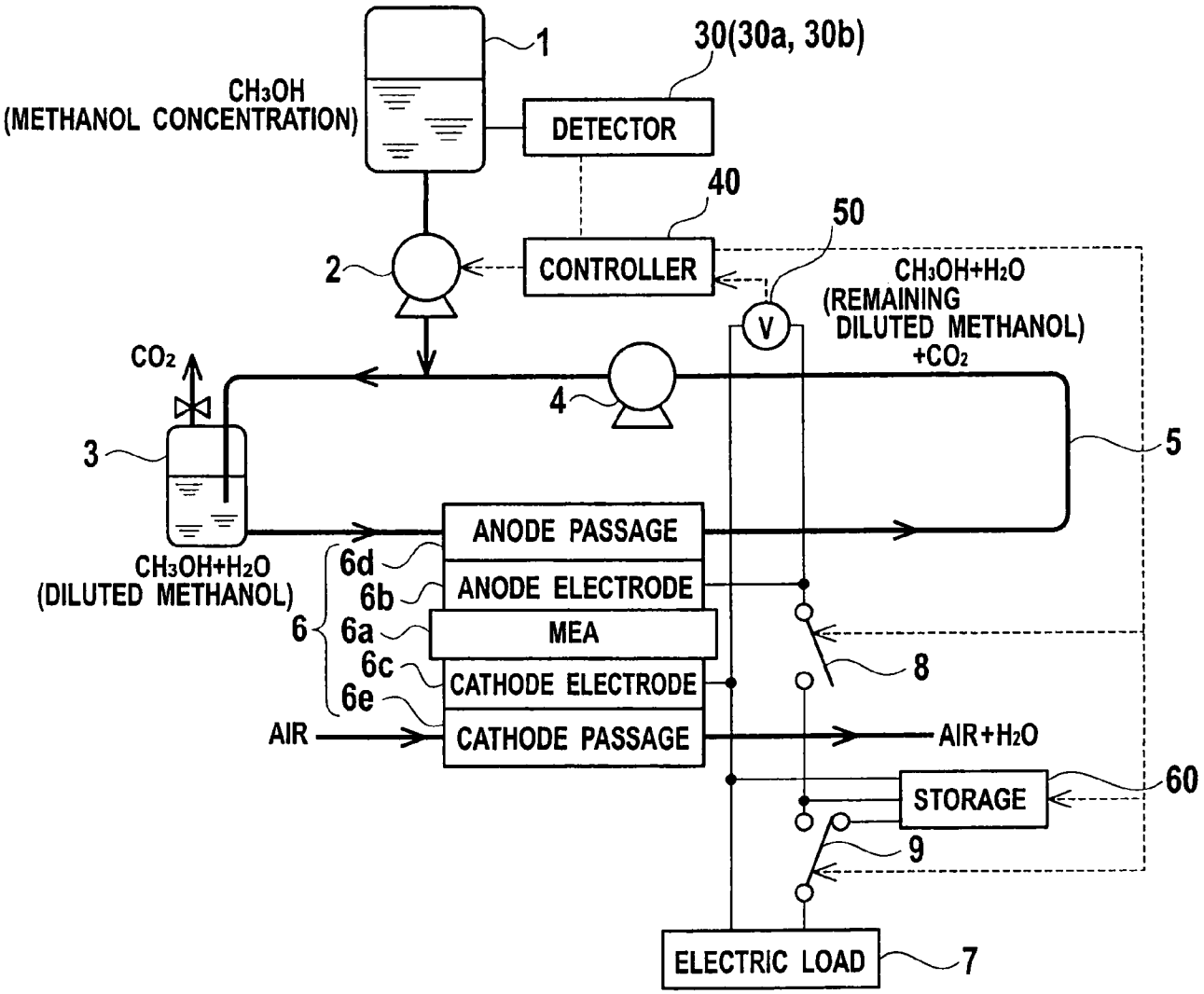
FIG. 4 is a block diagram illustrating an example of a fuel cell system according to the embodiment.

FIG. 4 shows an example of a fuel cell system (DMFC system) according to an embodiment of the present invention. The fuel cell system shown in FIG. 4 includes a fuel cell unit (stack 6) and the liquid container 1 for storing fuel to be delivered to the stack 6.

The stack 6 includes: an anode electrode 6*b*, a cathode electrode 6*c*, an electrolytic membrane (MEA) 6*a*, an anode channel 6*d* and a cathode channel 6*e*. The electrolytic membrane 6*a* is disposed between the anode electrode 6*b* and the cathode electrode 6*c*. The anode channel 6*d* is disposed on the anode electrode 6*b* side for circulating fuel. The cathode channel 6*e* is disposed on the cathode electrode 6*c* side for circulating an oxidizing agent containing air or oxygen. The diluted fuel pumped out from a circulating fuel tank 3 by a circulating pump 4 is delivered to the anode channel 6*d* through a pipe 5. Air is delivered to the cathode channel 6*e*.

A part of the diluted fuel, which is used for power generation in the anode channel 6*d* and thereafter discharged, is supplied again to the stack 6 by use of the circulating fuel tank 3, the circulating pump 4, and the pipe 5. The unreacted fuel and water contained in the diluted fuel are reused.

The stack 6 is connected to an electric load 7. The power generated by the stack 6 is consumed by the electric load 7. A switch 8 (current interruption means) is provided between the stack 6 and the electric load 7. By opening the switch 8, the power generated by the stack 6 can be fed to the electric load 7. By closing the switch 8 the power generated by the stack 6 can be blocked off, that is, the current fed to the electric load 7 substantially to zero. Here, "to reduce substantially to zero" refers to reduce the current fed from the stack 6 to the electric load 7 to zero except a current that unintentionally flows, such as a minute leakage current.

With a switch (switching means) 9 provided between the stack 6 and the electric load 7, the current fed to the electric load 7 can be switched between from the stack 6 and from an electric capacitor 60. According the necessity, the electric capacitor 60 stores the power generated by the stack 6 while electric current is applied from the stack 6 to the electric load 7.

A voltage measuring means 50 such as a volt meter or the like is connected to the stack 6 and can measure the output voltage of the stack 6. A controller 40 (control means) includes, for example, a computer with a motor driver, and is connected to the voltage measuring means 50. The controller 40 is capable of acquiring the value of an output voltage of the stack 6 measured by the voltage measuring means 50, opening/closing the switch 8, controlling a higher-concentration fuel pump 2 in response to the acquired value of the output voltage, and switching the switch 9.

In addition, the controller 40 regulates the amount of methanol to be supplied, using the higher-concentration fuel pump 2 in accordance with a steady-state output voltage and an unloaded output voltage. The steady-state output voltage is an output voltage of the stack 6 in a state of feeding a current to the electric load 7 connected to the stack 6. The unloaded output voltage is an output voltage of the stack 6 at a time after a predetermined time elapsed since a current fed to the electric load 7 from the stack 6 is reduced substantially to zero.

For appropriately replenishing the methanol contained in the diluted fuel that has been used for power generation, a liquid with a higher methanol concentration than in the liquid stored in the circulating fuel tank 3 is stored in the liquid container 1 (hereinafter, the liquid with a higher methanol concentration referred to as higher-concentration fuel).

The liquid container 1 is connected to the pipe 5 through the higher-concentration fuel pump 2 (methanol supplying means). The detector 30 is disposed adjacent to the liquid container 1 and detects air bubbles in the liquid container 1 and outputs the detection result to the controller 40.

Further, on the basis of both the historical information on the detection results of the detector 30 and two or more preset values of the delivery flow rate that are set by a user in advance, the controller 40 controls the higher-concentration fuel pump 2 so that the delivery flow rate of the higher-concentration fuel from the liquid container 1 can be reduced in a stepwise fashion. For example, when there is no history information on the air bubble detection by the detector 30, the controller 40 causes the higher-concentration fuel to be sucked from the liquid container 1 at the maximum delivery flow rate of the higher-concentration fuel. Then, every time the detector 30 detects an air bubble, the controller 40 reduces the delivery flow rate.

By using the fuel cell system according to the embodiment of the present invention, a generated air bubbles will not enters the system even if the fuel cell system is not stopped immediately after the near end is detected. Accordingly, a time sufficient for replacing the liquid container 1 can be secured while the fuel cell system can be operated stably.

(Method for Operating the Fuel Cell System)

Hereinafter, an example of a method for operating the fuel cell system according to an embodiment is described on the basis of the flowchart shown in FIG. 5.

In Step S11, a preset value of the delivery flow rate of the higher-concentration fuel sucked from the liquid container 1 shown in FIG. 4 is inputted to the controller 40. It is preferable that two or more preset values are preset. By setting two or more preset values, the delivery flow rate can be changed in a stepwise fashion in accordance with the preset values when the amount of higher-concentration fuel in the liquid container 1 becomes low.

In Step S13, the fuel cell system shown in FIG. 4 is operated. In accordance with a steady-state output voltage and an unloaded output voltage of the stack 6, the historical information on the detection results of air bubbles outputted from the detector 30, and the preset values set in Step S11, the controller 40 of FIG. 4 regulates the amount of methanol supplied with the higher-concentration fuel pump 2. For example, when there is no history information on an air bubble detection, the controller 40 reads the preset value of the maximum flow rate from a storage (not illustrated) to regulate the delivery flow rate.

If the residual amount of the higher-concentration fuel contained in the first porous member 21 shown in FIG. 1 becomes not more than a near end value, the air bubbles 25 will start to enter the sucked fuel. When the air bubbles 25 reach the boundary between the first porous member 21 and the second porous member 22, the air bubbles 25 will pass through the air bubble collector 23 side filled with higher-concentration fuel before passing through the second porous member 22. The detector 30*a* optically detects the air bubbles 25 collected in the air bubble collector 23 and outputs a detection result (detection signal) to the controller 40.

In Step S15, the controller 40 determines whether or not the detector 30 has detected an air bubble. When no air bubble is detected, the process proceeds to Step S21 and the operation of the fuel cell system is continued. When an air bubble is detected, the process proceeds to Step S17.

In Step S17, upon receipt of the detection signal from the detector 30*a*, the controller 40 reads the preset values of the delivery flow rate inputted in Step S11 to reduce the delivery flow rate. A reduction in the delivery flow rate will further reduce the near end value and thereby stops the entry of the air bubbles 25 into the air bubble collector 23 of FIG. 1 for a certain period. Accordingly, the higher-concentration fuel within the liquid container 1 can continue to be sucked without the entry of air bubbles.

In Step S19, the controller 40 warns a user that the residual amount of higher-concentration fuel within the liquid container 1 is low, and thereby prompts the user to replace the liquid container 1. Thereafter, the operation of the fuel cell system is continued in Step S21.

In Step S23, when the user replaces the liquid container 1, the fuel cell system will be stopped (finished) once. On the other hand, if the user does not replace the liquid container 1 at the time, the processes shown in Steps S13 to S21 will be repeated.

Figure 5:
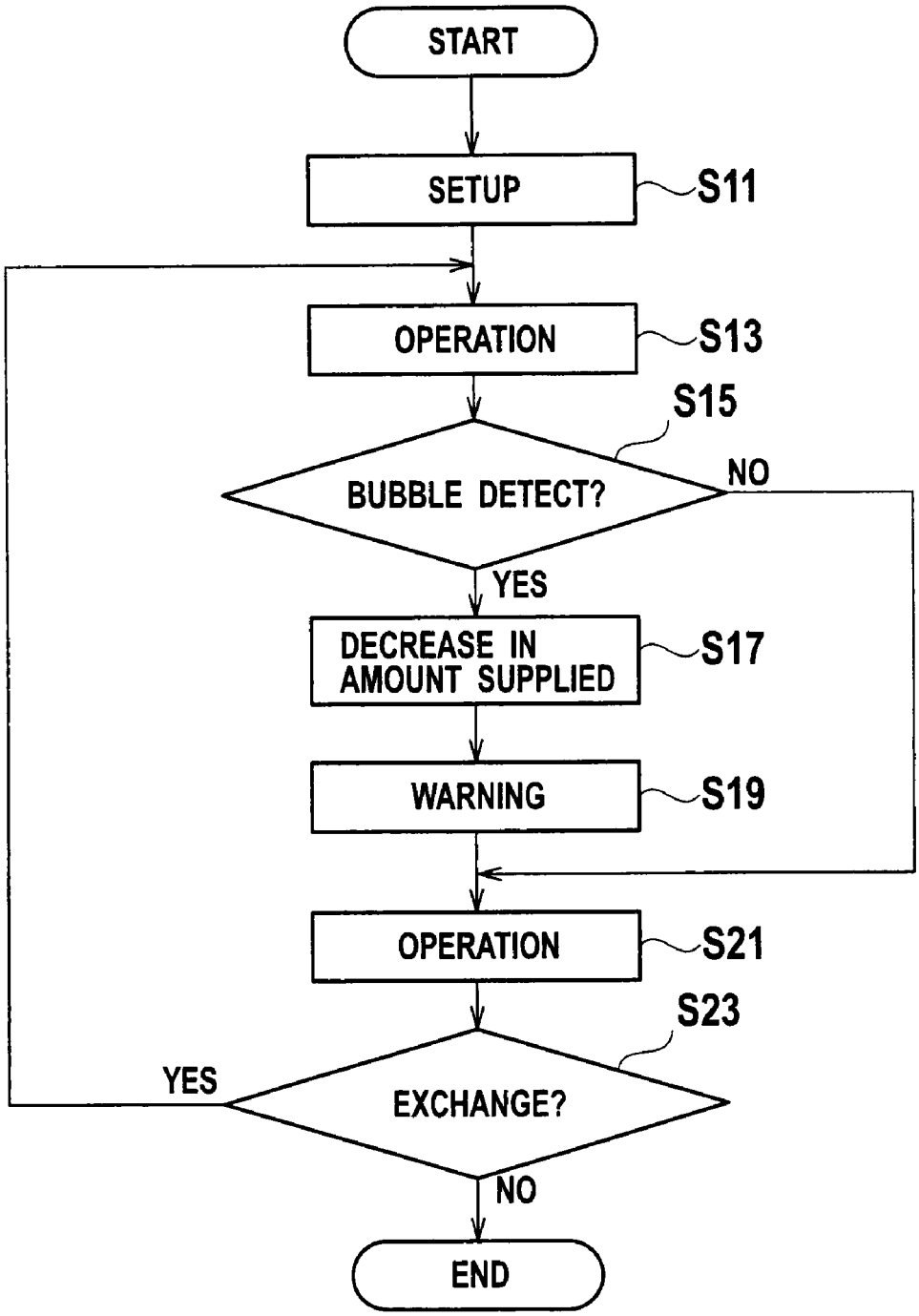
FIG. 5 is a flowchart illustrating a method of operating a fuel cell system according to the embodiment.

With the method for operating the fuel cell system according to the embodiment shown in FIG. 5, the controller 40 reduces the delivery flow rate of methanol from the liquid container 1 in a stepwise fashion in response to a detection signal from the detector 30 shown in FIG. 4. By repeating the reduction step as far as the fuel cell system allows, the higher-concentration fuel can be automatically sucked out so that the residual amount of fuel in the liquid container 1 may be as low as possible, and a time sufficient for replacing the liquid container 1 can also be secured.

In some types of fuel cell system, it is required that the delivery flow rate should be kept at a constant value. In that case, by setting the minimum value for the delivery flow rate to this constant value in advance, and by sucking the fuel, in the case where the fuel is sucked at a delivery flow rate greater than the constant value, discontinuously and so that the time-averaged delivery flow rate can become equal to the constant value, this requirement can be met.

If the liquid container 1 shown in FIG. 1 is vibrated, the air bubbles 25 may possibly enter the first porous member 21 despite a sufficient amount of liquid remains in the liquid container 1. In that case, the air bubble collector 23 will trap even the air bubbles 25 exists in the liquid because of this failure, as in the case where the residual amount of liquid reaches a near end value. Therefore, in Step S19, it is preferable not only to prompt a user to replace the liquid container 1 but also to notify the user whether or not the detected entry of air bubbles can be due to a failure.

(Modification of the Liquid Container 1)

Figure 6:
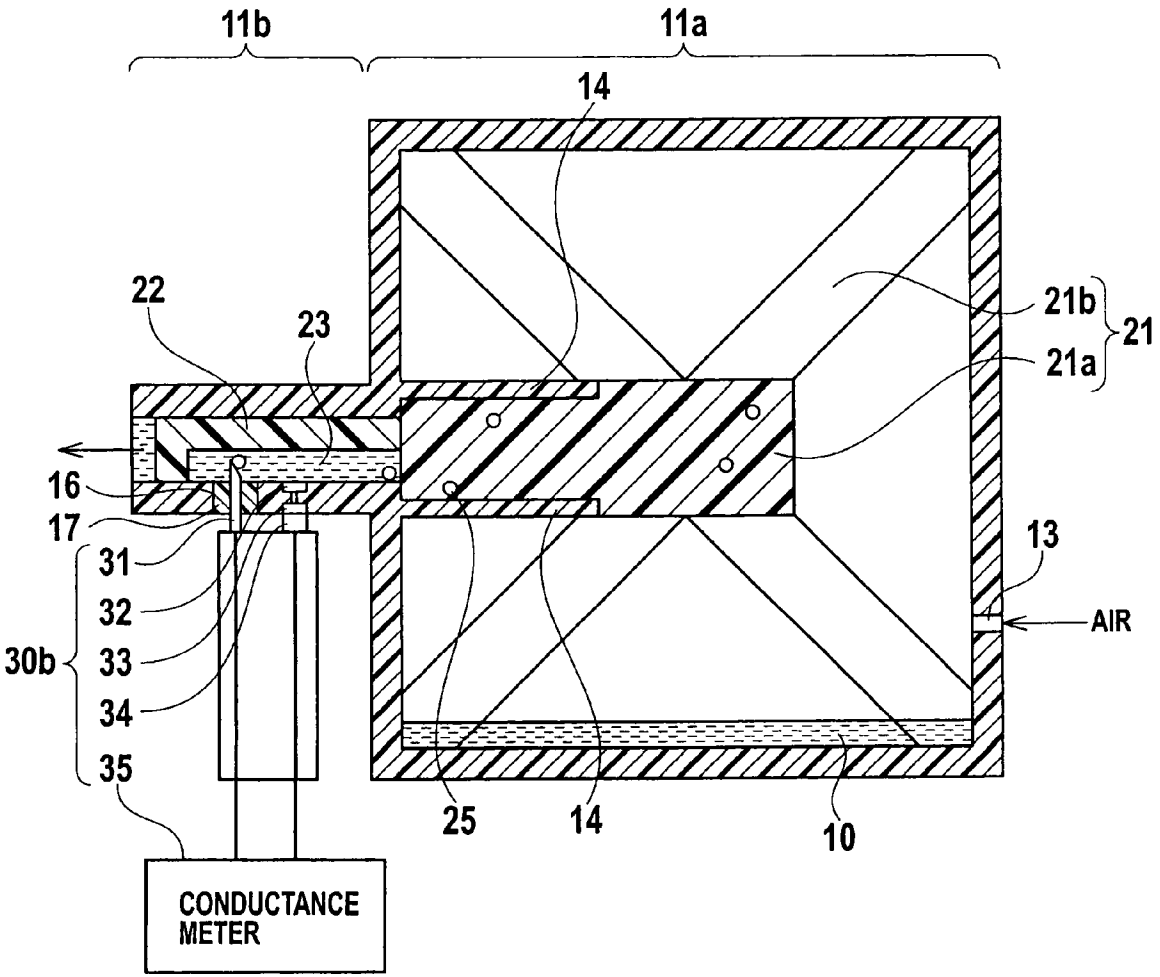
FIG. 6 is a cross-section view illustrating an example of a liquid container according to a modification of the present invention.

FIG. 6 shows a modification of the detector 30*a* shown in FIG. 1. The liquid container 1 shown in FIG. 6 is provided with an insertion opening 16 for inserting an air bubble detection probe 31 into the suction port 11*b*. An elastic member 17 is disposed in the insertion opening 16. The air bubble detection probe 31 is inserted into the air bubble collector 23 through the elastic member 17. The air bubble detection probe 31 is connected to an electric conductivity measurement circuit 35. Moreover, an electrode 32 is disposed adjacent to the insertion opening 16. The electrode 32 is connected to the electric conductivity measurement circuit 35 via a container-side connection terminal 33 and a body-side connection terminal 34.

According to the liquid container 1 shown in FIG. 6, the air bubble 25 accommodated in the air bubble collector 23 can be electrically detected with a detector 30*b*.

Various modifications will become possible for those skilled in the art after receiving the teachings of the present disclosure without departing from the scope thereof.

What is claimed is:

1. A liquid container, comprising:

a hollow body;

a tubular suction port coupled to the hollow body so as to form a closed receptacle;

a first porous member disposed in the hollow body; and a second porous member disposed in the suction port and being in contact with the first porous member, the second porous member having a liquid suction capability higher than that of the first porous member, wherein at least one of the first porous member and the second porous member is provided with a recess so as to establish an air bubble collector, one of walls of the recess is defined by a part of a boundary face between the first porous member and the second porous member, and the air bubble collector is defined by the suction port and the recess.

2. The liquid container of claim 1, further comprising an optically transparent window provided at a wall of the suction port, the window facing to the recess.

3. The liquid container of claim 1, further comprising, an insertion opening through which an air bubble detection probe is inserted, the insertion opening provided at a wall of the suction port, the insertion opening facing to the recess.

4. The liquid container of claim 1, further comprising a fixing pipe provided in the hollow body, a part of the first porous member is embedded in the fixing pipe.

5. The liquid container of claim 4, wherein the first porous member includes:

a first absorber having a tubular shape and embedded in the fixing pipe; and a second absorber coupled to the first absorber and radially extending from a center of the hollow body to the corners of the hollow body.

6. The liquid container of claim 1, wherein the second porous member is implemented by a tubular material with a recess, and thereby the air bubble collector is formed by the suction port, by the second porous member, and by a boundary face between the first and second porous members.

7. A fuel cell system comprising:

a fuel cell unit;

a liquid container configured to store fuel to be delivered to the fuel cell unit, the liquid container comprising:

a hollow body;

a tubular suction port coupled to the hollow body so as to form a closed receptacle;

a first porous member disposed in the hollow body; and a second porous member disposed in the suction port and being in contact with the first porous member, the second porous member having a liquid suction capability higher than that of the first porous member, at least one of the first porous member and the second porous member provided with a recess so as to establish an air bubble collector, one of walls of the recess defined by a part of a boundary face between the first porous member and the second porous member, and the recess is air bubble collector defined by the suction port and the recess;

a detector configured to detect an air bubble within the air bubble collector; and a controller configured to control a delivery flow rate of the fuel from the liquid container based on a detection result of the air bubble.

8. The fuel cell system of claim 7, wherein the controller reduces a delivery flow rate in a stepwise fashion based on a history of the detection result and a plurality of preset values for the delivery flow rate.

9. The fuel cell system of claim 7, wherein the liquid container further includes an optically transparent window provided at a wall of the suction port, the window facing to the recess.

10. The fuel cell system of claim 7, further comprising, an insertion opening through which an air bubble detection probe is inserted, the insertion opening provided at a wall of the suction port, the insertion opening facing to the recess.

11. The fuel cell system of claim 7, wherein the liquid container further comprises a fixing pipe provided in the hollow body, a part of the first porous member is embedded in the fixing pipe.

12. The fuel cell system of claim 11, wherein the first porous member includes:

a first absorber having a tubular shape and embedded in the fixing pipe; and a second absorber coupled to the first absorber and radially extending from a center of the hollow body to the corners of the hollow body.

13. The fuel cell system of claim 7, wherein the second porous member is implemented by a tubular material with a recess, and thereby the air bubble collector is formed by the suction port, the second porous member, and a boundary face between the first and second porous members.

* * * * *